US008118556B2

(12) United States Patent
Yang et al.

(10) Patent No.: US 8,118,556 B2
(45) Date of Patent: Feb. 21, 2012

(54) COMPRESSOR WHEEL FOR A TURBOCHARGER SYSTEM

(75) Inventors: Nan Yang, Dunlap, IL (US); Jeff A. Jensen, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 1059 days.

(21) Appl. No.: 12/011,684

(22) Filed: Jan. 29, 2008

(65) Prior Publication Data

US 2008/0178593 A1 Jul. 31, 2008

Related U.S. Application Data

(60) Provisional application No. 60/898,598, filed on Jan. 31, 2007.

(51) Int. Cl.
*F01D 5/14* (2006.01)

(52) U.S. Cl. ..... 416/183; 416/185; 416/188; 416/223 R; 416/241 R; 416/241 B; 29/888.024; 29/889.23

(58) Field of Classification Search ..... 416/183, 416/185, 188, 223 BM, 241 R, 241 B, 223 R; 29/888.02, 888.024, 889.4, 889.23
See application file for complete search history.

(56) References Cited

U.S. PATENT DOCUMENTS

| | | | | |
|---|---|---|---|---|
| 3,796,047 | A | 3/1974 | Crook et al. | |
| 6,019,927 | A | 2/2000 | Galliger | |
| 6,309,994 | B1 | 10/2001 | Marra et al. | |
| 6,481,970 | B2 | 11/2002 | Mukherjee et al. | |
| 6,532,658 | B2 | 3/2003 | Schreiber | |
| 6,588,485 | B1 | 7/2003 | Decker | |
| 6,629,556 | B2 | 10/2003 | Decker et al. | |
| 6,663,347 | B2 | 12/2003 | Decker et al. | |
| 6,754,454 | B1 | 6/2004 | Hiroshima et al. | |
| 6,766,850 | B2 | 7/2004 | Gegel et al. | |
| 6,904,949 | B2 | 6/2005 | Decker et al. | |
| 7,032,647 | B2 | 4/2006 | Gegel et al. | |
| 2005/0167009 | A1 | 8/2005 | Shoji et al. | |
| 2005/0238526 | A1 | 10/2005 | Schall | |
| 2006/0008354 | A1 | 1/2006 | Kramer et al. | |
| 2006/0162896 | A1 | 7/2006 | Schmitz et al. | |
| 2006/0291996 | A1 | 12/2006 | Kubota et al. | |
| 2009/0202814 | A1 * | 8/2009 | Jabado et al. | 416/241 R |

FOREIGN PATENT DOCUMENTS

| | | |
|---|---|---|
| EP | 1267084 | 12/2002 |
| EP | 1557567 | 7/2005 |
| WO | WO2005/016577 | 2/2005 |

* cited by examiner

*Primary Examiner* — Igor Kershteyn
(74) *Attorney, Agent, or Firm* — Liell & McNeil

(57) ABSTRACT

A turbocharger system for an internal combustion engine includes at least one compressor wheel. The at least one compressor wheel of a single stage or multiple stage turbocharger system is formed, such as by pressure casting, from at least one of an aluminum metal matrix composite and an aluminum alloy containing up to 5 weight percent scandium.

14 Claims, 1 Drawing Sheet

COMPRESSOR WHEEL FOR A TURBOCHARGER SYSTEM

CROSS-REFERENCE TO RELATED PATENT APPLICATIONS

This application claims priority to provisional U.S. Patent Application Ser. No. 60/898,598, filed Jan. 31, 2007, entitled "METHOD OF INCREASING TURBOCHARGER DURABILITY BY USE OF AN ALUMINUM METAL MATRIX COMPOSITE."

TECHNICAL FIELD

The present disclosure relates generally to a compressor wheel for a turbocharger system, and more particularly to a compressor wheel formed from at least one of an aluminum metal matrix composite and an aluminum alloy containing up to 5 weight percent scandium.

BACKGROUND

Aluminum alloys are commonly used in turbocharger systems of internal combustion engines due to their lightness and ease of casting. More specifically, aluminum alloys are commonly used to form compressor wheels in single stage and multiple stage turbocharger systems. Cast aluminum alloys, however, may have limited fatigue properties, which necessarily limit turbocharger durability. Therefore, in some cases, aluminum compressor wheels may be forged rather than cast. Although forging results in the formation of a much stronger and more durable compressor wheel, the production costs are very high.

In addition, since the temperatures of compressed air can reach between about 200 and 250 degrees Celsius in some applications, these increased temperatures may have an adverse affect on later stage compressor wheels. At these increased temperatures, aluminum alloys, including cast and forged alloys, no longer retain the strength sufficient to meet the material property requirements for a compressor wheel of the turbocharger system. One such example of a cast aluminum alloy is shown in U.S. Publication 2005/0167009 to Shoji et al.

There are two commonly recognized approaches to addressing this problem. One such approach includes the use of a titanium alloy instead of an aluminum alloy to make the compressor wheel, as is taught in U.S. Pat. No. 6,588,485 B1 to Decker or U.S. Pat. No. 6,663,347 B2 to Decker et al. While the titanium alloy typically retains its material strength at temperatures up to about 500 degrees Celsius, the titanium alloy is denser than the aluminum alloy, which may lead to decreased turbocharger transient response. In addition, the titanium alloy costs significantly more than the aluminum alloy, leading to significantly higher production costs.

Another recognized approach is to utilize an intercooler between each stage of a multiple stage turbocharger system, such as described in U.S. Pat. No. 3,796,047 and U.S. Pat. No. 3,870,029, both to Crook et al., and U.S. Pat. No. 6,398,517 B1 to Choi. Specifically, the intercooler may reduce the failure of the compressor components, due to overheating, by decreasing the temperature of the air between each of the turbocharger system stages. This approach, however, increases both the complexity and volume of the multiple stage turbocharger system and drastically increases total costs. Therefore, there is a continuing need for compressor wheels, including both first stage and later stage compressor wheels, made from materials that are sufficient to meet all material property requirements, without drastically increasing the total costs of the turbocharger system.

The present disclosure is directed to one or more of the problems set forth above.

SUMMARY OF THE DISCLOSURE

In one aspect, a turbocharger system for an internal combustion engine includes at least one compressor wheel. The compressor wheel is formed from at least one of an aluminum metal matrix composite and an aluminum alloy containing up to 5 weight percent scandium.

In another aspect, a compressor wheel for a turbocharger system is formed from at least one of an aluminum metal matrix composite and an aluminum alloy containing up to 5 weight percent scandium.

In yet another aspect, a method for making a compressor wheel for a turbocharger system includes a step of forming a pattern of the compressor wheel from an expendable material. A shell mold is formed around the pattern, and then the pattern is removed from the shell mold. The shell mold is next positioned within a housing, such that an inlet port of the shell mold communicates with an opening in the housing. The method also includes a step of providing a supporting material that substantially fills an open volume between an external surface of the shell mold and an interior surface of the housing. A molten material, including at least one of an aluminum metal matrix composite and an aluminum alloy containing up to 5 weight percent scandium, is pressure cast through the inlet port and into the mold.

DETAILED DESCRIPTION

Figure 1:
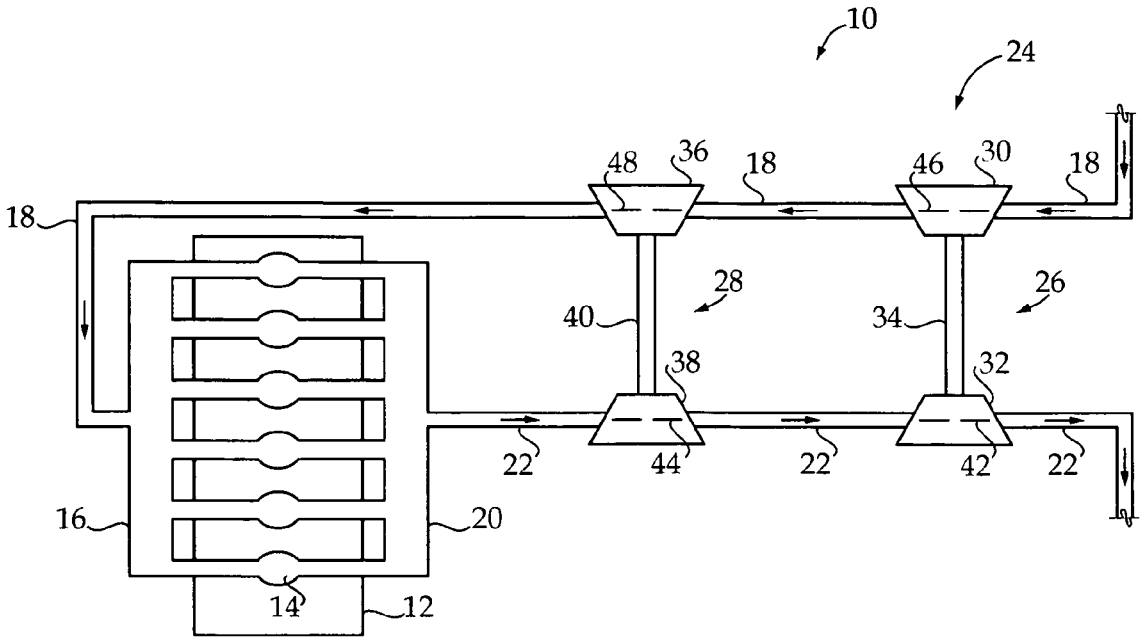
FIG. 1 is a schematic of an internal combustion engine including a turbocharger system according to the present disclosure.

An exemplary embodiment of an internal combustion engine 10 is shown generally in FIG. 1. For purposes of illustration, and not limitation, the engine 10 is that of a four stroke, compression ignition engine and includes an engine block 12 defining a plurality of combustion chambers or cylinders 14. In the exemplary engine 10, six combustion chambers 14 are shown; however, those skilled in the art will appreciate that any number of combustion chambers 14 may be applicable. The engine 10 also includes an intake manifold 16 in communication with the combustion chambers 14 and capable of providing air to the engine 10 via an intake air conduit 18. An exhaust manifold 20 is also in communication with the combustion chambers 14 and is capable of expending exhaust gas from the engine block 12 via an exhaust conduit 22.

The engine 10 also includes a turbocharger system of standard design, shown generally at 24. The turbocharger system 24 may include a single stage turbocharger system or a multiple stage turbocharger system, as shown. According to one embodiment, the turbocharger system 24 may include a first turbocharger 26 and a second turbocharger 28. Although two turbochargers 26 and 28 are shown, it should be appreciated that the present disclosure is applicable to an engine 10 using one or more turbochargers. The first turbocharger 26, as should be appreciated, generally includes a compressor 30 connected to a turbine 32 via a shaft 34. Similarly, the second turbocharger 28 includes a compressor 36 connected to a turbine 38 via a shaft 40.

During operation, exhaust gas leaving the exhaust manifold 20 passes through the exhaust conduit 22 and to wheels 42 and 44 of the turbines 32 and 38, respectively, to make them rotate. The rotation of the wheels 42 and 44 turns the shafts 34 and 40 which, in turn, rotate wheels 46 and 48 of the compressors 30 and 36, respectively. The rotation of the compressor wheels 46 and 48 pulls in ambient air through the intake conduit 18 and compresses it. It should be appreciated that a multiple stage turbocharger system may include compressor wheels operating in series, as shown, or, alternatively, multiple compressor wheels positioned in parallel on a common shaft.

One or both of the compressor wheels 46 and 48, according to the present disclosure, may be formed from an aluminum metal matrix composite. According to one embodiment, the aluminum metal matrix composite may be based on aluminum alloys designed to exhibit, for example, increased fatigue resistance, higher temperature operation properties, increased durability, or other properties know to those skilled in the art. Such aluminum alloys may include, for example, A206, A224, and A354, although numerous other alloys may be used. In addition, the aluminum metal matrix composite may be reinforced with a reinforcement material.

According to one embodiment, discontinuous reinforcement materials may be used, such as, for example, ceramic particles, ceramic fibers, and ceramic whiskers. More specifically, desirable reinforcement materials may include SiC, $Al_2O_3$, $SiO_2$, AlN, BN, TiC, $TiB_2$, $B_4C$, $W_2C$, $ZrO_2$, or intermetallics, such as, for example, $Al_3Sc$ or $Al_3Zr$, $Al_3Ti$, or $Al_3(Sc, X)$, where X stands for Zr, Ti, Y, Hf, etc. However, those skilled in the art will recognize that other discontinuous, or continuous, reinforcement materials may be used. According to one embodiment, the reinforcement materials may be blended into the aluminum metal matrix composite, preformed and then infiltrated, precipitated from a matrix alloy solution, or reaction formed in-situ during blending or infiltration. Further, it may be desirable to use a volume fraction of reinforcement materials between about 10% and about 20%. However, the reinforcement materials used, including the amount, the fabrication method thereof, and the location and shape of the reinforcement, may be selected, or varied, to achieve desired mechanical properties.

Alternatively, and also in accord with the present disclosure, one or both of the compressor wheels 46 and 48 may be formed from an aluminum alloy containing up to 5 weight percent scandium. The properties of such an alloy, especially at elevated temperatures, may be greatly enhanced through coherent precipitates of intermetallic compounds, such as, for example, $Al_3Sc$, $Al_3(Sc, Zr)$, etc. The aluminum alloy containing up to 5 weight percent scandium, along with the aluminum metal matrix composite, may be modified, as necessary, for ease of reinforcement and/or castability. It should be appreciated that the aluminum metal matrix composite, as described above, may be based on an aluminum alloy containing up to 5 weight percent scandium.

The compressor wheels 46 and 48, as described, may be manufactured using casting, powder metallurgy, or spray formed methods, followed by any necessary shaping processes, as should be appreciated by those skilled in the art. Preferable casting methods for the compressor wheels 46 and 48 may include any of a variety of casting processes including, but not limited to, vortex casting, vacuum casting, centrifugal casting, die casting, and pressure casting. It should be appreciated, however, that the compressor wheels 46 and 48 may be formed using any known methods.

Figure 2:
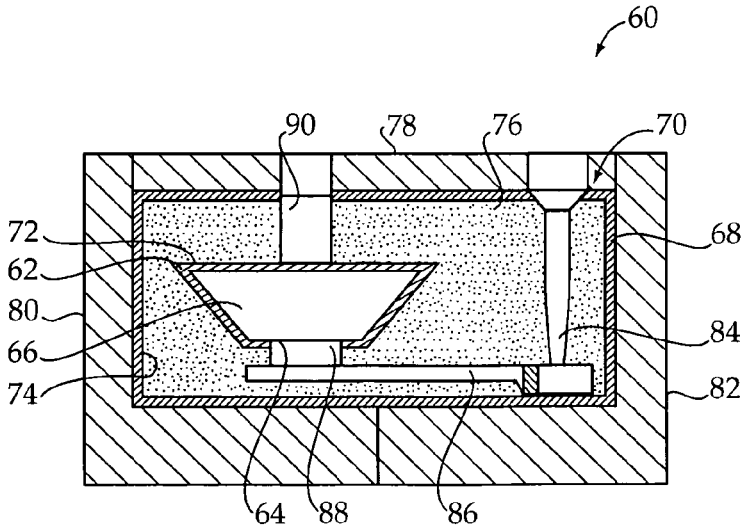
FIG. 2 is a sectioned view of a pressure casting apparatus for making a compressor wheel of the turbocharger system of FIG. 1.

According to one embodiment, the compressor wheels 46 and 48 may be formed using a pressure casting apparatus 60, as shown in FIG. 2. According to this embodiment, a pattern (not shown) of one of the compressor wheels 46 and 48 may be formed from an expendable material, such as, for example, wax, wax blends, polystyrene, plastics, evaporative foam, or other desirable material. It should be appreciated that the dimensions of the compressor wheel pattern may be slightly larger than the compressor wheel 46, 48 to account for shrinkage of the casting material as it solidifies.

Once the compressor wheel pattern has been formed, a shell mold 62 having a desired thickness is formed around the pattern. This process, as should be appreciated by those skilled in the art, may involve preparing a slurry and repeatedly dipping the compressor wheel pattern into the slurry to form a multiple layered shell mold 62. According to one embodiment, the slurry may include a refractory, ceramic based powder of alumina or zirconia, although numerous mixtures are contemplated. In forming the shell mold 62, an inlet portion 64 of the shell mold 62 may be left uncoated to preserve an entryway into the mold.

Once a desired thickness of the shell mold 62 has been obtained, the shell mold 62 is allowed to dry. The compressor wheel pattern is then removed from the shell mold 62, such as by applying heat. Applying heat may melt or evaporate the expendable material of the compressor wheel pattern and may also sinter the refractory, ceramic based material of the shell mold 62. The shell mold 62, and any necessary casting components, as described below, are positioned in a housing 68 such that the inlet port 64 is in communication with an opening 70 in the housing 68. The housing 68 may be fabricated from a variety of high strength materials, such as, for example, steel. Once the shell mold 62 and other casting components are positioned within the housing 68, an open volume exists between an exterior surface 72 of the shell mold 62, and other casting components, and an interior surface 74 of the housing 68.

A supporting material 76 substantially fills the open volume such that all surfaces of the shell mold 62 are covered and supported by the supporting material 76. The supporting material 76, as should be appreciated, may provide structural support to the shell mold 62 and facilitate heat transfer away from the shell mold 62. The supporting material 76 may include a low melting point metallic alloy, such as, for example, an alloy of lead, bismuth, and antimony, which is poured into the open volume in molten form and allowed to solidify around the shell mold 62. Alternatively, the supporting material 76 may include a granular material, such as carbon particles, natural or synthetic alumina-based sand, zirconia-based sand, and metal particles. Additional components, such as those useful for vacuum pulling the supporting material 76 may also be incorporated into the pressure casting apparatus 60.

The housing 68 is then disposed between die blocks 78, 80, and 82 of the pressure casting apparatus 60. Die blocks 78, 80, and 82, as should be appreciated by those skilled in the art, provide support for the housing 68 and, ultimately, the shell mold 62. In addition, die blocks 78, 80, and 82 may include necessary openings, such as for introducing a casting material into the shell mold 62. Next, at least one of the aluminum metal matrix composite and the aluminum alloy containing up to 5 weight percent scandium, in molten form, is pressure cast into the shell mold 62. Specifically, the molten material is pressurized and poured into the shell mold 62 through a sprue 84, runner 86, and in-gate 88, as should be appreciated by those skilled in the art. Additionally, a riser 90 may be provided to compensate for internal contraction of the molten material as it solidifies. Specifically, and according to one embodiment, a ceramic plunger (not shown) may be inserted into the riser 90 for applying pressure to the casting material. Additional components, such as, for example, filters and insulation materials, may also be provided to further facilitate and/or improve the casting process. For example, and according to one embodiment, the shell mold 62 may be pre-heated to improve the casting process.

It should be appreciated that a compressor wheel made using the above described pressure casting method, regardless of the casting materials used, may offer advantages over a compressor wheel formed using another known method. Specifically, the disclosed pressure casting method may provide a compressor wheel having improved durability and improved fatigue resistance over other compressor wheels. For example, although specific casting materials are described, a compressor wheel made from an aluminum alloy, such as a forged aluminum alloy, using the described pressure casting method may exhibit improved mechanical properties over aluminum alloy compressor wheels made using other known methods.

Additionally, one skilled in the art should recognize that the turbine wheels 42 and 44 may be formed from a material other than the aluminum metal matrix composite and the aluminum alloy containing up to 5 weight percent scandium. Specifically, and because the turbine wheels 42 and 44 are subject to exhaust gases having much higher temperatures than the compressor wheels 46 and 48, the turbine wheels 42 and 44 may be made from, for example, a superalloy or an intermetallic. Additionally, one skilled in the art will recognize that the above examples of alloys, reinforcement materials, and fabrication methods for compressor wheels 46 and 48 are meant as examples only and are not intended to limit the spirit or scope of this disclosure.

INDUSTRIAL APPLICABILITY

The compressor wheel of the present disclosure may find application in a variety of turbocharger systems. Although a multiple stage turbocharger system is depicted, it should be appreciated that a single stage turbocharger system may also benefit from the presently disclosed compressor wheel. Further, the compressor wheel may be specifically applicable to a first stage compressor wheel and one or more later stage compressor wheels.

Referring to FIGS. 1 and 2, and during typical operation of an internal combustion engine 10, exhaust gas leaving an exhaust manifold 20 of the engine 10 passes through an exhaust conduit 22 and to wheels 42 and 44 of turbines 32 and 38, respectively, to make them rotate. The rotation of the wheels 42 and 44 turns shafts 34 and 40 which, in turn, rotate wheels 46 and 48 of compressors 30 and 36, respectively. The rotation of the compressor wheels 46 and 48 pulls in ambient air through the intake conduit 18 and compresses it. Since the temperatures of compressed air can reach between about 200 and 250 degrees Celsius, these increased temperatures may have an adverse affect on later stage compressor wheels.

A compressor wheel, such as one of compressor wheels 46 and 48, made of an aluminum metal matrix composite or an aluminum alloy containing up to 5 percent weight scandium may exhibit improved durability, improved fatigue resistance, and higher temperature operation properties over traditional compressor wheels. Specifically, an aluminum metal matrix composite or an aluminum alloy containing up to 5 percent weight scandium may provide almost twice the strength of an alternative aluminum alloy between about 200 and 250 degrees Celsius. Additionally, an aluminum metal matrix composite or an aluminum alloy containing up to 5 percent weight scandium, at increased temperatures, may have improved transient response over a titanium alloy, without the increased production costs. Further, later stage compressor wheels made from the disclosed composite or alloy may avoid the cost and complexity of utilizing an intercooler between stages of a multiple stage turbocharger. Therefore, it should be appreciated that the disclosed compressor wheel offers significant advantages over traditional compressor wheels of both single stage turbocharger systems and multiple stage turbocharger systems.

It should be understood that the above description is intended for illustrative purposes only, and is not intended to limit the scope of the present disclosure in any way. Thus, those skilled in the art will appreciate that other aspects of the disclosure can be obtained from a study of the drawings, the disclosure and the appended claims.

What is claimed is:

1. A turbocharger system for an internal combustion engine, comprising:

at least one compressor wheel; and wherein the at least one compressor wheel is formed from an aluminum metal matrix composite including an aluminum alloy containing up to 5 weight percent scandium.

2. The turbocharger system of claim 1, wherein the turbocharger system includes one of a single stage turbocharger system and a multiple stage turbocharger system.

3. The turbocharger system of claim 1, wherein the compressor wheel is formed using at least one of casting, powder metallurgy, and spray forming.

4. The turbocharger system of claim 3, wherein the compressor wheel is formed using at least one of vortex casting, vacuum casting, centrifugal casting, die casting, and pressure casting.

5. The turbocharger system of claim 1, further including at least one turbine wheel, wherein the turbine wheel is formed from a material other than the aluminum metal matrix composite and the aluminum alloy containing up to 5 weight percent scandium.

6. A turbocharger system for an internal combustion engine, comprising:

at least one compressor wheel;

wherein the at least one compressor wheel is formed from at least one of an aluminum metal matrix composite and an aluminum alloy containing up to 5 weight percent scandium;

wherein the turbocharger system includes one of a single stage turbocharger system and a multiple stage turbocharger system;

wherein the aluminum metal matrix composite further includes a reinforcement material, and wherein the reinforcement material includes at least one of ceramic particles, ceramic fibers, and ceramic whiskers.

7. The turbocharger system of claim 6, wherein the reinforcement material is selected from the group consisting of SiC, $Al_2O_3$, $SiO_2$, AlN, BN, TiC, $TiB_2$, $B_4C$, $W_2C$, $ZrO_2$, $Al_3Sc$, and $Al_3Zr$, $Al_3Ti$.

8. A compressor wheel for a turbocharger system, comprising:

the compressor wheel formed from an aluminum metal matrix composite including an aluminum alloy containing up to 5 weight percent scandium.

9. The compressor wheel of claim 8, wherein the compressor wheel is formed using at least one of casting, powder metallurgy, and spray forming.

10. The compressor wheel of claim 9, wherein the compressor wheel is formed using at least one of vortex casting, vacuum casting, centrifugal casting, die casting, and pressure casting.

11. A compressor wheel for a turbocharger system, comprising:

the compressor wheel formed from at least one of an aluminum metal matrix composite and an aluminum alloy containing up to 5 weight percent scandium;

wherein the aluminum metal matrix composite further includes a reinforcement material, and wherein the reinforcement material includes at least one of ceramic particles, ceramic fibers, and ceramic whiskers.

12. The compressor wheel of claim 11, wherein the reinforcement material is selected from the group consisting of SiC, $Al_2O_3$, $SiO_2$, AlN, BN, TiC, $TiB_2$, $B_4C$, $W_2C$, $ZrO_2$, $Al_3Sc$, and $Al_3Zr$, $Al_3Ti$.

13. A method for making a compressor wheel for a turbocharger system, comprising:

forming a pattern of the compressor wheel from an expendable material;

forming a shell mold around the pattern;

removing the pattern from the shell mold;

positioning the shell mold within a housing such that an inlet port of the shell mold communicates with an opening in the housing;

providing a supporting material that substantially fills an open volume between an external surface of the shell mold and an interior surface of the housing; and pressure casting a molten material including at least one of an aluminum metal matrix composite and an aluminum alloy containing up to 5 weight percent scandium through the inlet port and into the shell mold.

14. The method of claim 13, wherein the providing step includes providing a granular material that substantially fills the open volume.

* * * * *